US006622948B1

(12) United States Patent
Haas et al.

(10) Patent No.: US 6,622,948 B1
(45) Date of Patent: Sep. 23, 2003

(54) SPRAY GUN FOR COATING OBJECTS

(75) Inventors: Gerald Haas, St. Gallen (CH); Karl Buschor, St. Gallen (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 09/763,314

(22) PCT Filed: Jun. 9, 1999

(86) PCT No.: PCT/EP99/03970

§ 371 (c)(1),
(2), (4) Date: Feb. 22, 2001

(87) PCT Pub. No.: WO00/10724

PCT Pub. Date: Mar. 2, 2000

(30) Foreign Application Priority Data

Aug. 22, 1998 (DE) ..... 198 36 280

(51) Int. Cl.[7] ..... B05B 5/00

(52) U.S. Cl. ..... 239/706; 239/433; 239/526; 239/600; 239/708; 118/629

(58) Field of Search ..... 239/690, 690.1, 239/706, 707, 419, 423, 424, 433, 525, 526, 600, 112, 113, 708; 118/308, 629

(56) References Cited

U.S. PATENT DOCUMENTS

| | | | | | |
|---|---|---|---|---|---|
| 4,246,294 | A | | 1/1981 | Jordan | |
| 4,286,734 | A | * | 9/1981 | Tonge | 239/433 |
| 4,993,645 | A | * | 2/1991 | Buschor | 118/629 |
| 5,829,681 | A | * | 11/1998 | Hamel et al. | 239/526 |
| 6,021,965 | A | * | 2/2000 | Hartle | 239/706 |
| 6,375,094 | B1 | * | 4/2002 | Schroeder et al. | 239/113 |

FOREIGN PATENT DOCUMENTS

| | | |
|---|---|---|
| EP | 0 645 192 A | 3/1995 |
| WO | 98 23383 A | 6/1998 |

* cited by examiner

*Primary Examiner*—Steven J. Ganey
(74) *Attorney, Agent, or Firm*—Lowe Hauptman Gilman & Berner LLP

(57) ABSTRACT

A spray gun coating objects with a coating material. Its barrel (2) and its grip (4), at least their basic shapes, are one integral structure (6).

15 Claims, 2 Drawing Sheets

SPRAY GUN FOR COATING OBJECTS

FIELD OF THE INVENTION

The present invention relates to an object-coating spray gun defined in the preamble of claim 1.

In particular the invention relates to a spray gun coating objects with a powder coating material. However the invention is not restricted to this specific implementation and also may be used to coat objects with liquid coating materials.

BACKGROUND ART

A object-coating spray gun of this kind is known from the European patent document 0 383 030 A. Therein the gun structure consists of a barrel and of a separate grip affixed to it. A powder tube configured at an angle corresponding to that subtended between barrel and grip is inserted first into this grip and then from the rear into the barrel, the grip and barrel being connected in the process. The powder tube may be integral or consist of two tube segments mutually joined at their crossing site before being inserted into grip and barrel. A chamber to receive a high-voltage generator is configured in the barrel above the powder duct and runs as far as above the grip zone. At least one high-voltage electrode to electrostatically charge the coating powder is connected to the high-voltage generator at the downstream barrel end.

U.S. Pat. No. 3,777,981 discloses a spray gun which coats objects with coating powders and comprises a barrel-affixed grip and a flexible powder hose running through grip and barrel. Moreover spray guns are known from the German Auslegeschrift 20 30 388 and from the German patent document 3545885 C for coating objects with liquid coating powder and fitted with a grip affixed to a barrel.

SUMMARY OF THE INVENTION

Powder spray guns generate a fine dust undesirably penetrating the gun or forced out of the gun at interfaces which per se are sealed hermetically. As regards liquid-coating spray guns, there is the danger that atomized liquid particles shall deposit at interfaces of the spray gun. Both spray guns coating by means of powder and by means of liquids run the danger that high-voltage leakage paths shall be created at the interfaces between the high-voltage components electrostatically charging the coating material and the gun segments which must be electrically insulated therefrom.

The objective of the invention is to so design the spray gun that no leakage shall arise. The spray gun of the invention is of simple and economical design and requires practically no maintenance work.

In accordance with an aspect of the present invention, the second line segment is fitted with an extension which is impermeable to the coating material and which runs axially backward as far as the rear end of the barrel. The extension passes through an end wall at the rear end of the barrel and the extension and the end wall are mutually sealing.

In accordance with another aspect of the present invention, the first and second line segments have a connected state where the first line segment is connected to a rear end of the second line segment and a disconnected state where the first line segment is disconnected from the rear end of the second line segment. In the connected state, the first line segment defines a limit for a rearward displacement of the second line segment, and in the disconnected, the second line segment is displaceable rearwardly beyond the limit.

The present invention also provides a spray gun for coating objects with a coating material, the gun comprising a grip, a barrel, a coating-material feeding duct and a plug member. The grip has therein a first longitudinal channel. The barrel has opposite front and rear end openings and a second longitudinal channel extending through an entire length of the barrel from the front end opening to the rear end opening. The barrel is connected to the grip so that the first and second channels are communicated with each other. The coating-material feeding duct runs through the first and second channels. The plug member has opposite front and rear portions and an intermediate portion connecting the front and rear portions. The front and intermediate portions are sized and shaped to be receivable within the second channel and removable from the second channel via the rear end opening of the barrel. The rear end portion is sized and shaped to close the rear end opening in a sealing manner. The front portion of the plug member is made hollow and defines a segment of the coating-material feeding duct.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

This problem is solved by the invention by the features of claim 1.

BRIEF DESCRIPTION OF THE DRAWINGS

The invention is illustratively described below in relation to a preferred embodiment and the drawings.

DETAILED DESCRIPTION OF THE DRAWINGS

Figure 1:
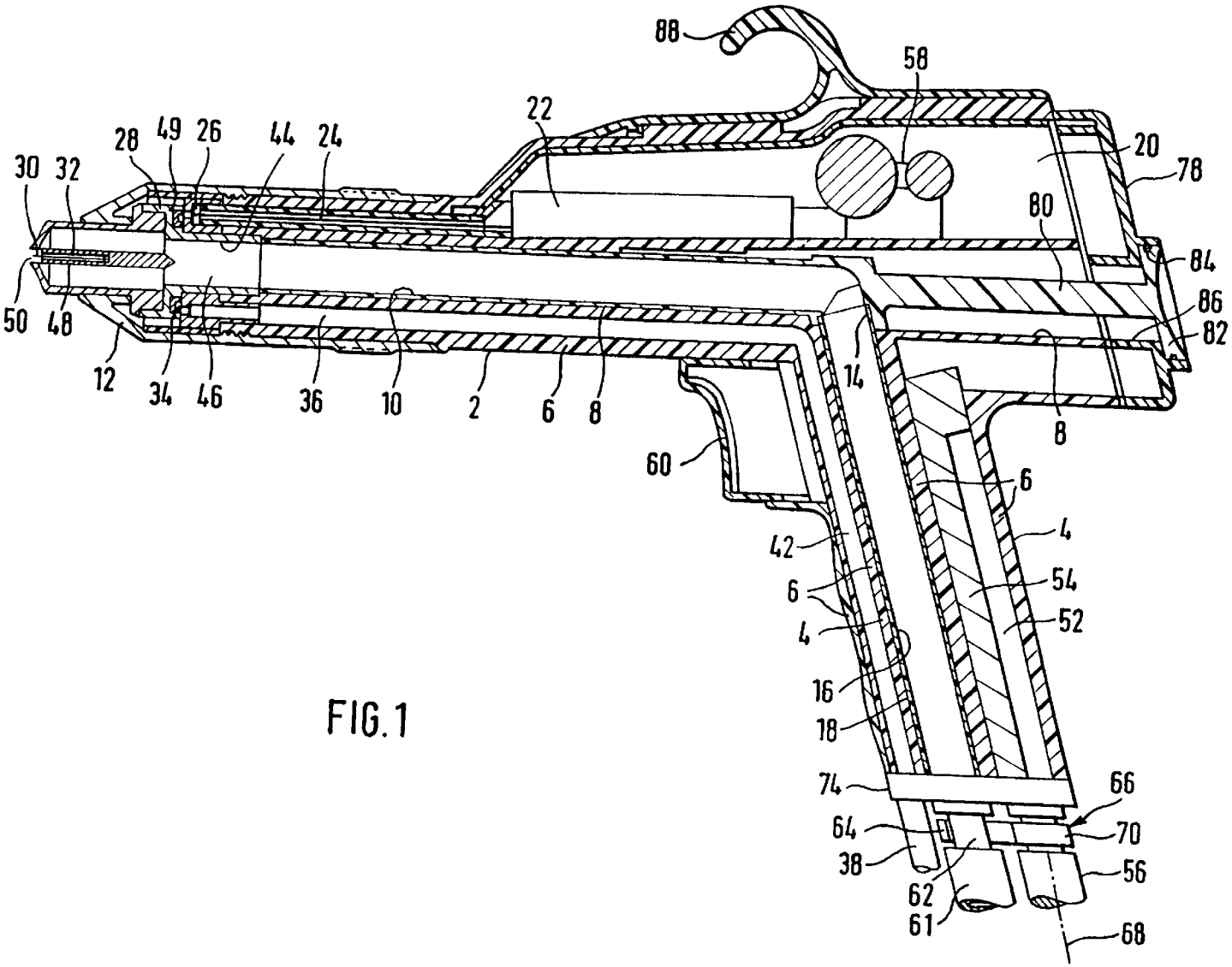
FIG. 1 schematically shows a longitudinal section of a spray gun of the invention to spray a coating powder on objects.
Figure 2:
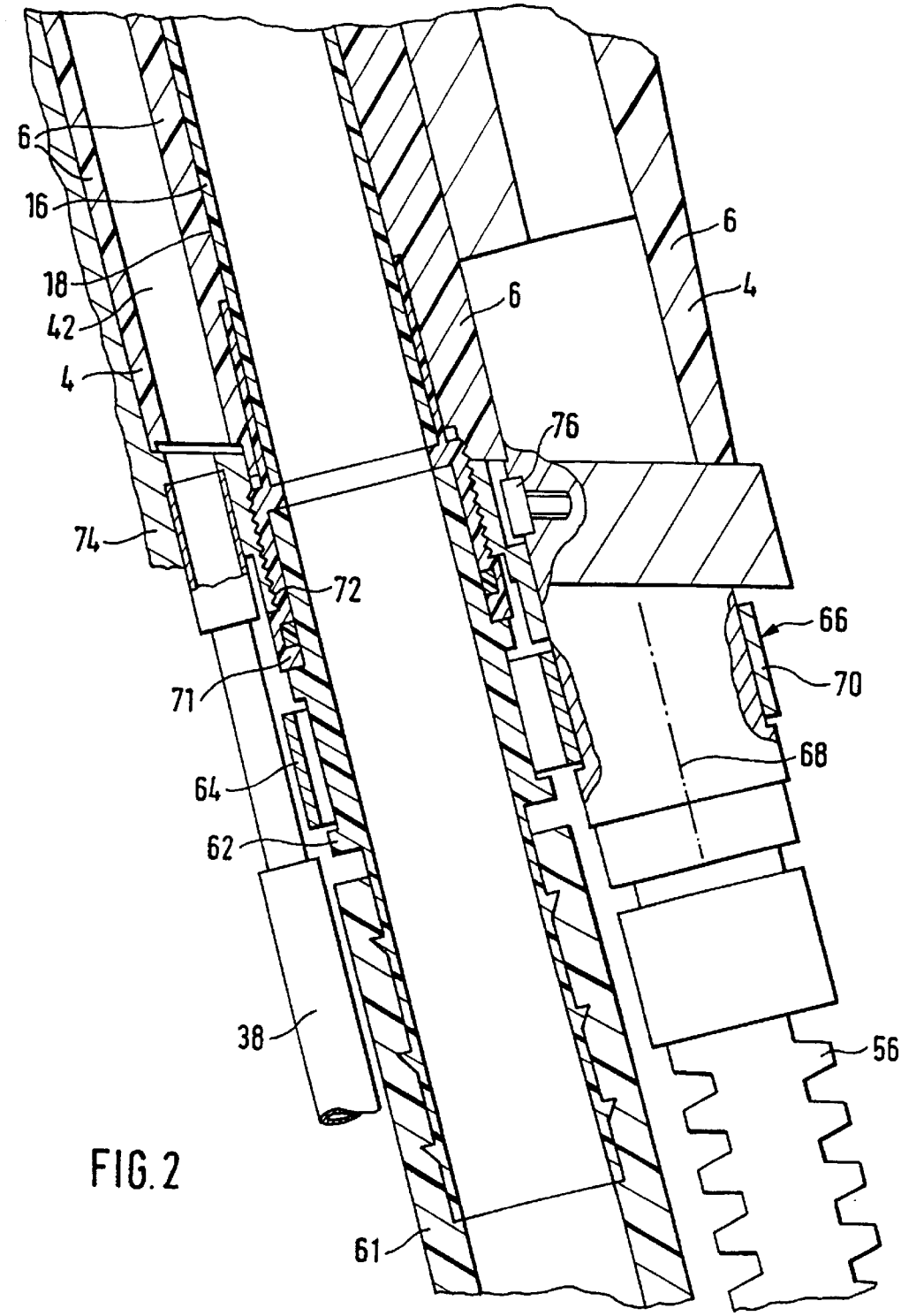
FIG. 2 is an enlarged view of the grip of FIG. 1 with connected ducts.

The spray gun shown in FIGS. 1 and 2 to coat object with a coating powder contains an integral housing structure 6 preferably made of plastic and constituting a barrel 2 and a grip 4, or at least their basic structures.

A line segment 10 is inserted from the rear to the fore into a duct 8, which is continuous from the front to the rear inside the barrel 2 of the integral structure 6 and runs forward as far as an atomizer 12. The upper end of a grip line-segment 16 is inserted in hermetic manner from below upward into an aperture subtending a funnel shape from the outside to the inside in the outside wall of the line segment 10, and said line segment 16 is inserted from below upward into a grip duct 18 configured in the longitudinal grip direction in the grip segment of the integral structure 6.

The two line segments 10 and 16 may be flexible hoses though preferably they shall be rigid plastic tubes.

The barrel duct 8 and the grip duct 18 each run straight in the integral structure 6 and cross one another. Each duct 8 and 18 clamps its line segment 10 and 16 respectively, radially, but not axially.

The barrel line-segment 10 must be inserted first into the barrel duct 8 before the grip line-segment 16 can be inserted into the grip duct 18. The line segment 16 is kept radially in position by its grip duct 18 and in turn keeps the barrel line-segment 10 axially in position without the need for additional fasteners. The grip line-segment 16 can be removed downward and the barrel line-segment 10 can be removed rearward from the integral structure 6 and also be exchanged as necessary.

An open through sealable chamber 20 receiving a high-voltage generator 22 is present in the integral structure 6 above the barrel duct 8 and runs across the position of the grip 4, said generator being electrically connected through an electric line 24, an electric switch 26 and an electrode support 28 of the atomizer 12 to one or several high-voltage electrode(s) 30 used in known manner to electrostatically charge the coating material.

The electrode 30 projects from a compressed-air duct 32 which runs through the electrode support to an annular channel 34 which can be fed with compressed air through a compressed-air duct 36 and a compressed-air hose 38. The compressed air is used to cleanse the high-voltage electrode 30 from coating material and to transmit electric charges from the high-voltage electrode 30 into the coating material. The compressed air duct 36 is situated in the integral structure 6 and comprises a duct segment 40 running parallel to the barrel duct 8 and through the barrel 2 and furthermore a duct segment 42 running parallel to the grip duct 18 and through the grip 4.

The electrode support 28 comprises a tube segment 44 which runs from the front to the rear inside the barrel duct 8 of the barrel 2 and which tightly abuts the front end of the barrel line segment 10. The tube segment 44 is fitted with a radial bracket 46 beyond which projects a thinner tubular segment 48 of substantially smaller diameter and from which in turn the high-voltage electrode 30 projects forward 30 and protrudes forward until just before a slotted nozzle 50. The electrical switch 26 is mounted radially outside the tube segment 44 at an axial distance of more than 1.0 cm from the rear end of the tube segment on the back side of a radial protrusion 49 of this tube segment 44.

A third duct 52 running in the grip 4 parallel to the grip duct 18 is configured in the integral structure 6 to connect electric connector elements 54 to an electric low-voltage cable 56 through a grip aperture of this third duct 52 at the lower grip end. The electric connector elements 54 are electrically connected to the low-voltage side for instance by a transformer 58 of the high-voltage generator 22 and furthermore are fitted with an omitted switch turning ON and OFF by means of a trigger 60 the feed of coating material.

A feed hose 61 for the coating material is detachably connected by a quick-connect means—preferably a plug-in connection—with the grip line-segment 16. In the preferred embodiment of the invention, a hookup element 62 connecting the hose 61 to the grip line-segment 16 presents a radial extension into which the tab 64 of a rotatable blocking yoke 66 can be pivoted about an axis of rotation 68 parallel to the grip line-segment 16 into and out of engagement for the purpose of securing the axial position. In the shown embodiment, the axis of rotation 68 consists of a hookup part of the low-voltage cable 56, an annular part 70 of the blocking yoke 66 being plugged onto said hookup part. The blocking yoke 66 may include an omitted grip part to pivot said blocking yoke 66.

As shown in particular by FIG. 2, the hookup part 62 can be plugged into a hookup bush 71 irrotationally affixed (bonded or welded) to the line segment 16 and screwed by an outside thread 72 into the inside thread of a cap 74. The cap 74 is mounted on the underside of the grip 4 and runs upward on the front side of the grip as far as the trigger 60 and is affixed to the integral structure 6.

The low-voltage cable 56 is detachably affixed by a known bayonet connector 76 to the grip cap 74.

The chambers configured in the barrel 2 of the integral structure 6 are open to the rear and can be sealed by a second cap 78 mounted on the rear side of the gun.

The barrel line-segment 10 is fitted with an integral rod 80 running from the transition site to the grip line-segment 16 to the rear through the second cap 78 and furthermore with an integral sealing disk 82 on the outside of the second cap 78. Together a seal 84, the sealing disk 82 constitutes a hermetic seal of the chambers of the barrel 2 at the back side of the gun.

A feedthrough aperture 86 is configured in the second cap 78 at the backside of the barrel 2 and exhibits a diameter large enough to allow removing rearward the barrel line-segment 10 together with the rod 80 and out of the barrel 2, for instance for cleaning or exchanging, provided however that beforehand the grip line-segment 16 was removed downward and out of the grip line-segment 10. The grip 16 is always exchangeable.

A hook 88 may be affixed on the top side of the gun to the integral structure 6 or it may be integral with said integral body.

What is claimed is:

1. A spray gun for coating objects with a coating material, said gun comprising a barrel having opposite front and rear ends;

a grip extending obliquely from a portion of the barrel;

a coating-material line running through a longitudinal direction of the barrel and in a longitudinal direction of the grip, said line comprising a first line segment situated in the grip and a second line segment situated in the barrel, said first and second line segments extending with respect to each other at an angle less than 180° and being detachably connected to each other at a crossing site thereof; and an atomizer positioned at the front end of the barrel; wherein at least a part of the barrel and at least a part of the grip are formed integrally with each other so as to constitute an integral structure; and the second line segment is fitted with an extension which is impermeable to the coating material and which runs axially backward as far as the rear end of the barrel, wherein said extension passes through an end wall at the rear end of the barrel and said extension and the end wall are mutually sealing.

2. Spray gun as claimed in claim 1, wherein said extension passes through a through hole of said end wall; and the second line segment is sized and shaped to pass through said through hole, whereby said second line segment is removable and replaceable via said through hole.

3. Spray gun as claimed in claim 1, further comprising a chamber accessible from the rear end of the barrel to receive a high-voltage generator, said chamber being positioned in the integral structure above the second line segment.

4. Spray gun as claimed in claim 1, further comprising a compressed-air duct for feeding compressed air to the atomizer, wherein said compressed-air duct is housed in the integral structure.

5. Spray gun as claimed in claim 1, further comprising a duct for receiving connector elements to connect an electrical cable, wherein said duct is housed in the integral structure in the grip and runs substantially parallel to the first line segment.

6. Spray gun as claimed in claim 1, further comprising a blocking yoke pivotable about an axis of rotation, that is substantially parallel to the first line segment, and fitted with a blocking tab which, by means of a pivoting motion of the blocking yoke, is caused to engage/disengage a recess constituted in a hookup element by means of which a hose feeding the coating material can be hooked up to the first line segment.

7. Spray gun as claimed in claim 1, wherein at least one of the first and second line segments is a rigid tube.

8. A spray gun for coating objects with a coating material, said gun comprising a barrel;

a grip;

a coating-material line running through a longitudinal direction of the barrel and in a longitudinal direction of the grip, said line comprising a first line segment situated in the grip and a second line segment situated in the barrel, said first and second line segments extending with respect to each other at an angle less than 180° and being detachably connected to each other at a crossing site thereof; and an electric switch for electrically connecting a high-voltage generator to at least one high-voltage electrode, wherein at least a part of the barrel and at least a part of the grip are formed integrally with each other so as to constitute an integral structure;

the first and second line segments are axially displaceable within the grip and the barrel, respectively; and said switch is mounted radially outside a tube segment made of an electrically insulating material to be axially spaced by at least 1.0 cm from a rear end face of the tube segment on a rear side of a radial protrusion which projects radially outward from said tube segment, the rear end face of said tube segment adjoining in sealing manner a front end of the second line segment and constituting an extension of the coating-material line represented by said second line segment.

9. A spray gun for coating objects with a coating material, said gun comprising a barrel;

a grip;

a coating-material line running through a longitudinal direction of the barrel and in a longitudinal direction of the grip, said line comprising a first line segment situated in the grip and a second line segment situated in the barrel, said first and second line segments extending with respect to each other at an angle less than 180° and being detachably connected to each other at a crossing site thereof; and an atomizer positioned adjacent to a front end of the second line segment, wherein at least a part of the barrel and at least a part of the grip are formed integrally with each other so as to constitute an integral structure;

the first and second line segments are axially displaceable within the grip and the barrel, respectively;

the first and second line segments have a connected state where the first line segment is connected to a rear end of the second line segment and a disconnected state where the first line segment is disconnected from the rear end of the second line segment;

in the connected state, the first line segment defines a limit for a rearward displacement of the second line segment; and in the disconnected state, the second line segment is displaceable rearwardly beyond said limit.

10. A spray gun for coating objects with a coating material, said gun comprising:

a grip having therein a first longitudinal channel;

a barrel having opposite front and rear end openings and a second longitudinal channel extending through an entire length of said barrel from the front end opening to the rear end opening, said barrel being connected to said grip so that said first and second channels are communicated with each other;

a coating-material feeding duct running through said first and second channels; and a plug member having opposite front and rear portions and an intermediate portion connecting the front and rear portions, said front and intermediate portions being sized and shaped to be receivable within said second channel and removable from said second channel via said rear end opening of said barrel, said rear end portion being sized and shaped to close said rear end opening in a sealing manner;

wherein said front portion of said plug member is made hollow and defines a segment of said coating-material feeding duct.

11. The gun of claim 10, further comprising an electrically powered atomizer installed in said front end opening of said barrel.

12. The gun of claim 10, wherein said coating-material feeding duct further comprises another segment running in said first channel, said another segment plugging in an aperture formed in a wall of the segment defined by the front portion of said plug member, said another segment being radially confined by said grip but axially displaceable in said first channel.

13. The gun of claim 12, wherein said another segment plugs in said aperture in a sealing manner and prevents said segment from being axially displaced along said second channel.

14. The gun of claim 10, wherein at least a part of the barrel and at least a part of the grip are formed integrally with each other so as to constitute an integral structure.

15. The gun of claim 10, wherein said front, intermediate and rear portions of said plug member are made integrally with each other.

* * * * *